US005385008A

United States Patent [19]

Makino et al.

[11] Patent Number: 5,385,008

[45] Date of Patent: Jan. 31, 1995

[54] YARN BREAK DETECTING DEVICE FOR SPINNING MACHINE

[75] Inventors: Syozaburo Makino; Isao Takahashi, both of Kanagawa; Masanori Kishigami, Tokyo, all of Japan

[73] Assignee: Nippon Selen Co., Ltd., Kanagawa, Japan

[21] Appl. No.: 234,630

[22] Filed: Apr. 28, 1994

Related U.S. Application Data

[63] Continuation of Ser. No. 943,330, Sep. 10, 1992, abandoned.

[30] Foreign Application Priority Data

Sep. 20, 1991 [JP] Japan ..... 3-270010

[51] Int. Cl.[6] ..... D01H 13/16; B65H 57/00

[52] U.S. Cl. ..... 57/81; 57/264; 242/157 R; 242/157 C

[58] Field of Search ..... 57/81, 264, 75, 78, 57/80, 358; 242/157 R, 157 C

[56] References Cited

U.S. PATENT DOCUMENTS

| | | | |
|---|---|---|---|
| 3,844,101 | 10/1974 | Schwartz | 57/81 |
| 3,899,868 | 8/1975 | Lee, Jr. et al. | 57/81 X |
| 3,968,637 | 7/1976 | van Andel et al. | 57/81 |
| 4,027,232 | 5/1977 | Domig et al. | 242/157 R X |
| 4,254,613 | 3/1981 | Arita et al. | 57/81 |
| 4,256,247 | 3/1981 | Loepfe | 242/157 R X |
| 4,267,554 | 5/1981 | Loepfe et al. | 57/81 X |
| 4,393,647 | 7/1983 | Kitamura | 57/81 |
| 4,481,763 | 11/1984 | Fiedler et al. | 57/264 X |
| 4,965,567 | 10/1990 | Meyer | 57/81 X |

*Primary Examiner*—Daniel P. Stodola
*Assistant Examiner*—Michael R. Mansen
*Attorney, Agent, or Firm*—Koda and Androlia

[57] ABSTRACT

A yarn break detecting device for a spinning machine includes detectors, a feed section and a control section. The detectors each include a pair of electrodes having substantially the same area and adapted to electrically induce a potential depending on static electricity charged on a yarn, a differential amplifier, a waveform shaper and an indicator lamp. The induced potential is then amplified and rectified to turn on the indicator lamp and concurrently fed to a microprocessor in the control section for operation processing, resulting in positions at which yarn break occurs and the number of yarn breaks being indicated.

1 Claim, 6 Drawing Sheets

YARN BREAK DETECTING DEVICE FOR SPINNING MACHINE

This is a continuation of application Ser. No. 07/943,330, filed Sep. 10, 1992, now abandoned.

BACKGROUND OF THE INVENTION

This invention relates to a yarn break detecting device for a spinning machine, a weaving machine or the like, and more particularly to a yarn break detecting device which is adapted to be mounted on a spinning machine such as a ring spinning machine, a weaving machine or the like (hereinafter referred generally to as "spinning machine") to detect and display yarn break and subject predetermined control data to operation processing depending on the amount or degree of yarn break. Accordingly, the term "spinning machine" used herein indicates a spinning machine such as a ring spinning machine in a narrow sense, however, it indicates, in a broad sense, a weaving machine and the like as well as a spinning machine.

Conventionally, a variety of yarn break detectors of the electronic type which are constructed into different configurations based on various principles have been proposed and partially put into practice. Such conventional yarn break detectors of the electronic type are generally classified into a photoelectric system which is constructed so as to detect a yarn traveling between a light emitter and a light receptor and a piezoelectric system which is constructed so as to apply vibration due to tension of a yarn traveling to a piezoelectric element to detect traveling of the yarn.

Unfortunately, the photoelectric system, when it is used for detecting yarn break occurring in a spinning machine, causes restrictions to be imposed on arrangement of the light emitter and light receptor with respect to a yarn guide due to their configuration and results in malfunction due to adhesion of dust to an optical system. Also, the piezoelectric system has disadvantages of requiring to contact the system with a yarn and causing malfunction of the system due to mechanical vibration. Further, both systems are not suitable for detecting yarn break in a ring spinning machine because a yarn guide for spinning in the ring spinning machine is varied with time depending on the amount of a yarn spun.

SUMMARY OF THE INVENTION

The present invention has been made in view of the foregoing disadvantages of the prior art.

Accordingly, it is an object of the present invention to provide a yarn break detecting device for a spinning machine which is capable of exhibiting resistance to electrical noise and resistance to mechanical vibration, excluding affection of light beams, and extensively accomplishing detection of yarn break with high sensitivity.

It is another object of the present invention to provide a yarn break detecting device for a spinning machine which is capable of being down-sized and light-weighed.

It is a further object of the present invention to provide a yarn break detecting device for a spinning machine which is capable of being readily mounted on a lappet of a spinning machine conventionally used or the like.

It is still another object of the present invention to provide a yarn break detecting device for a spinning machine which is capable of being simplified in structure and decreased in manufacturing cost.

It is a still further object of the present invention to provide a yarn break detecting device for a spinning machine which is capable of satisfactorily contributing to maintenance of a spinning machine, and quality control, production control and process control of products.

In accordance with the present invention, a yarn break detecting device for a spinning machine is provided. The yarn break detecting device includes a plurality of detectors arranged in correspondence to yarns spun by and discharged from the spinning machine, a feed section connected through connectors to the detectors, and a control section connected to the feed section. The detectors each include a pair of electrodes having substantially the same area and adapted to electrically induce a signal depending on static electricity charged on the yarn, a differential amplifier of a high input resistance value for differentially amplifying the signal induced by the electrodes to produce an output signal, a waveform shaper for shaping a waveform of the output signal of the differential amplifier to produce an output signal, and an indicator lamp turned on by the output signal of the waveform shaper. The feed section includes a feed line and shift circuits for feeding the signals of the detectors therethrough. The control section includes a DC stabilizing power supply, an oscillator, a microprocessor for subjecting the number of yarn breaks and a period of time during which yarn break occurs to operation processing, and an indicator for carrying out setting of the microprocessor and display of data.

In a preferred embodiment of the present invention, the detectors each are arranged in a casing formed of a material exhibiting an electrostatic shielding effect.

In a preferred embodiment of the present invention, the electrodes in each pair which have substantially the same area each comprise a plate-like conductor arranged on an insulating substrate, are exposed through an aperture formed at the casing and are provided in correspondence to the yarns spun by and discharged from the spinning machine.

In a preferred embodiment of the present invention, the casing is formed with a mounting hole through which a snail wire of a lappet provided at the spinning machine and mounted on the Lappet by means of a mounting pin made of an elastic material.

In a preferred embodiment of the present invention, the mounting hole is formed into an elliptic shape in section corresponding to that of the snail wire and formed on one side thereof with a gap sufficient to permit the snail wire to be inserted at an intermediate portion thereof into the mounting hole.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Figure 1:
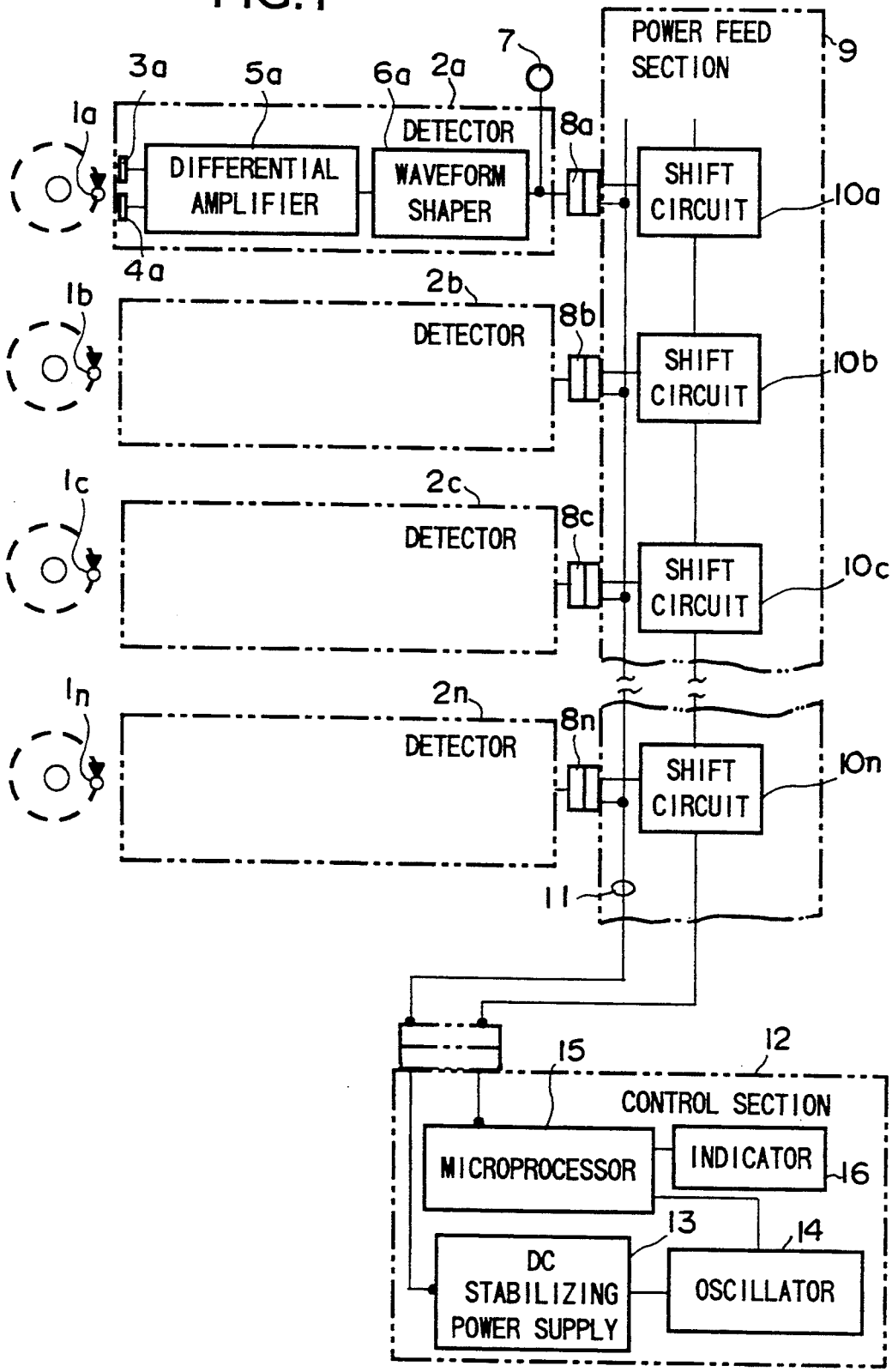
FIG. 1 is an electrical schematic view showing a principle of operation of an embodiment of a yarn break detecting device for a spinning machine according to the present invention.

Now, a yarn break detecting device for a spinning machine according to the present invention will be described hereinafter with reference to the accompanying drawings.

FIGS. 1 to 5 illustrate an embodiment of a yarn break detecting device for a spinning machine according to the present invention.

A yarn break detecting device of the illustrated embodiment includes a plurality of detectors 2a to 2n arranged in correspondence to a plurality of spun yarns 1a to in arranged in a spinning machine. The yarns 1a to in are adapted to travel in a direction perpendicular to the sheet of FIG. 1 in snail wires 20a to 20n while turning in a balloon-like manner as indicated at an arrow of dotted lines in FIG. 1, respectively. The detectors 2a to 2n are mounted on lappets 19a to 19b and include induction electrodes 3a to 3n and 4a to 4n in pairs, respectively. The induction electrodes 3a and 4a to 3n to 4n in the detectors 2a to 2n are arranged so as to correspond to the yarn 1a to in, respectively. The detectors 2b to 2n are constructed and function in the same manner as the detector 2a. The yarns 1a to in each have static electricity charged therein because of turning and vibration thereof and the like, so that the static electricity is induced to the electrodes 3a and 4a to 3n to 4n, resulting in the electrodes outputting a potential or signal. The outputs of the electrodes in respective pairs are fed to corresponding differential amplifiers 5a to 5n, resulting in being amplified, respectively, and then are shaped into signals of a reference value in waveform shapers 6a to 6n, of which outputs each are used to light an indicator lamp 7. The differential amplifiers 5a to 5n are also connected through connectors 8a to 8n to shift circuits 10a to 10n and a feed line 11 arranged in a feed section 9 in parallel. The shift circuits 10a to 10n each are connected to an interface of a microprocessor 15 of a control section 12 by means of a shift register which may comprise, for example, a JK flip-flop IC. This permits a yarn break signal to be fed through each of the shift circuits 10a to 10n to the microprocessor 15, so that it causes an indicator 16 to display the number of yarn breaks, positions thereof and the like and, as required, subjects data on an operation rate of the spinning machine, its output and the like to operation processing, resulting in the results being printed out. The control section 12 further includes a DC stabilizing power supply 13 connected to each of the detectors 2a to 2n and an oscillator 14 for operating the shift circuits 10a to 10n, the microprocessor 15 and the like.

Figure 2:
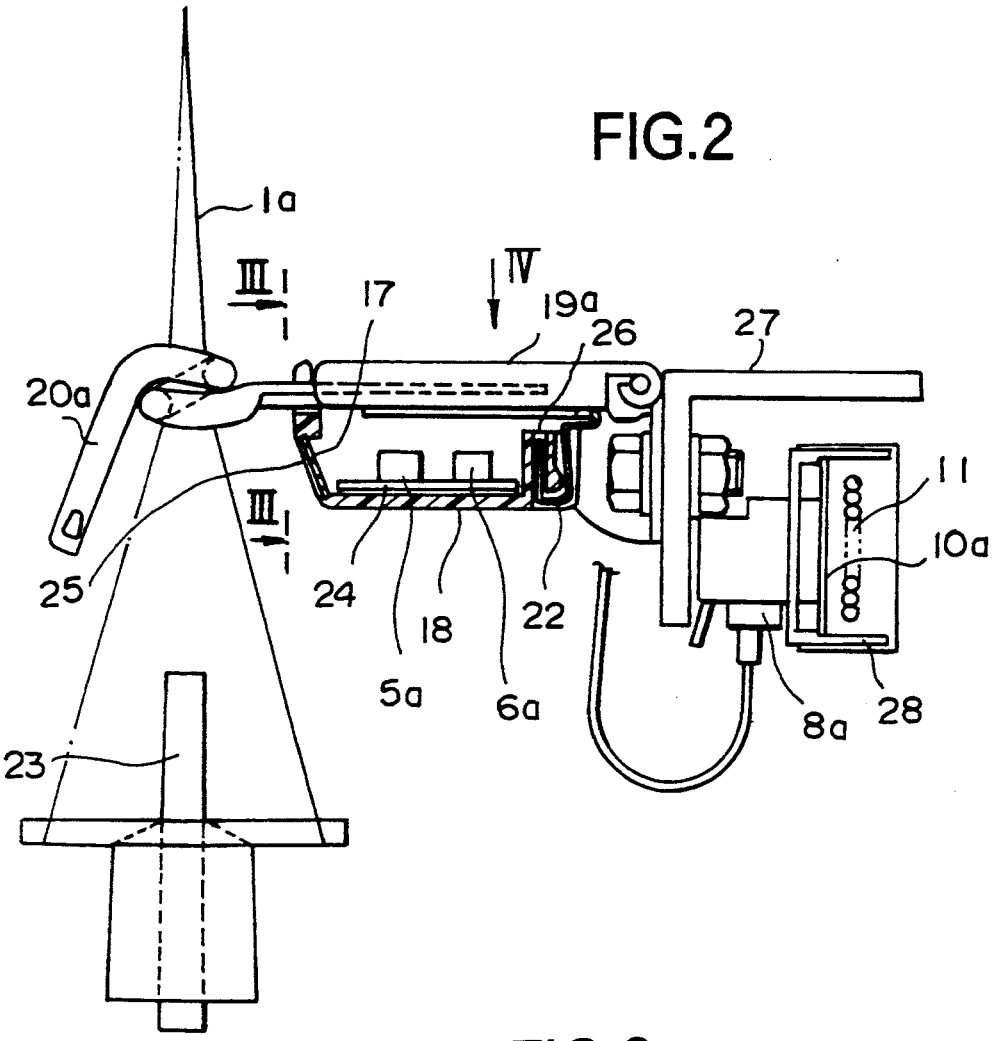
FIG. 2 is a vertical sectional side elevation view showing a detector mounted on a lappet.
Figure 3:
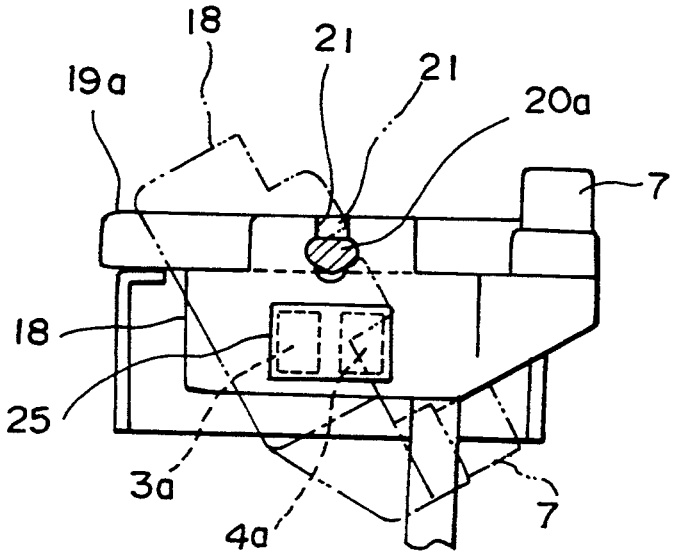
FIG. 3 is a sectional view taken along line III—III of FIG. 2.
Figure 4:
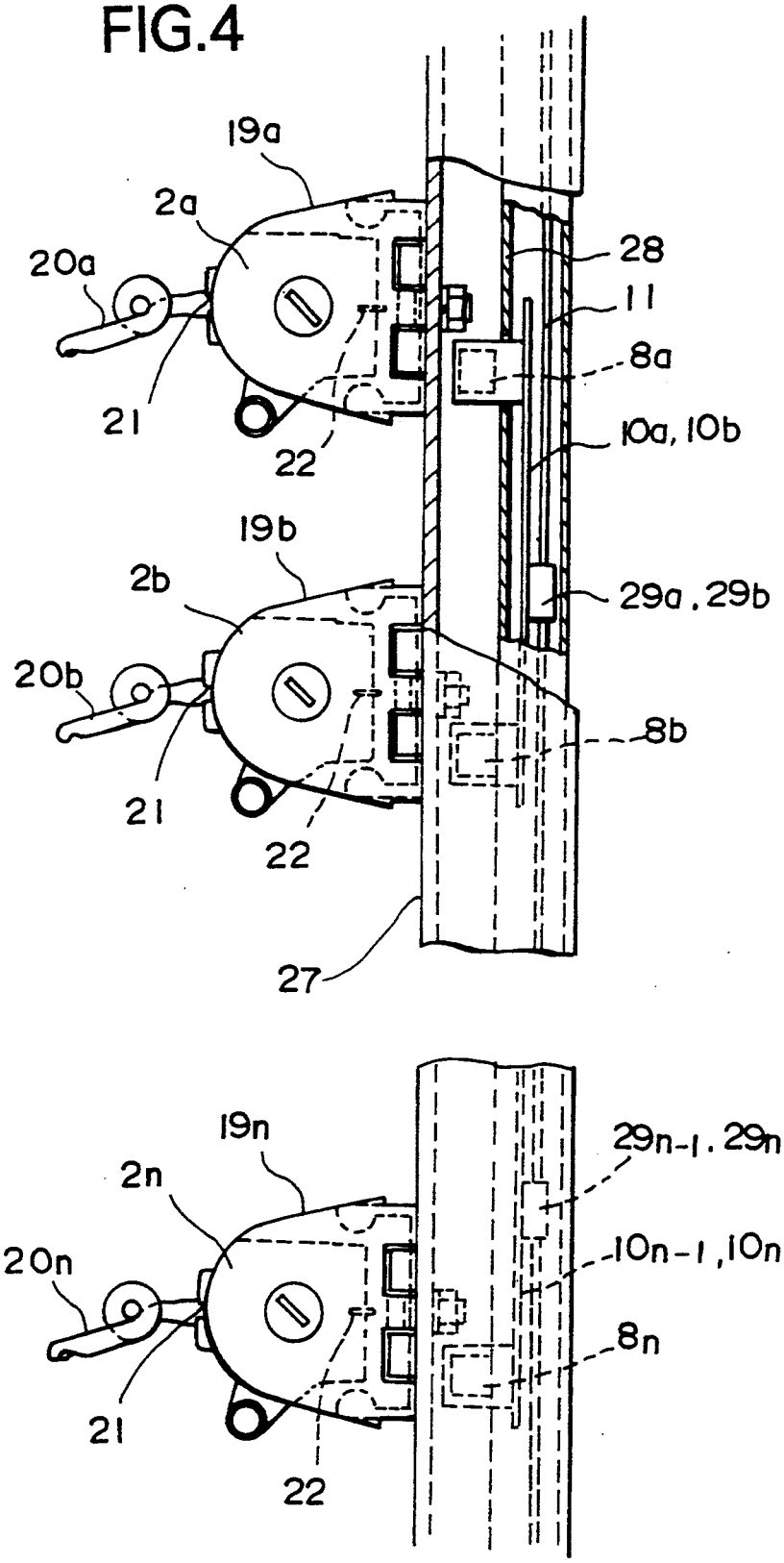
FIG. 4 is a plan view taken in a direction indicated at an arrow IV in FIG. 2.

The detectors 2a to 2n are preferably mounted on the lappets 19a to 19n, respectively, as shown in FIGS. 2 to 4. More particularly, the yarn 1a is adapted to be wound up on a bobbin 23 while turning in the snail wire 20a, resulting in traveling. The electrodes 3a and 4a each comprise a plate-like conductor of substantially same area and mounted on a surface of an insulating substrate 17. Also, each of the electrodes 3a and 4a is exposed through a window 25 formed at a casing 18 of the detector 2a, to thereby face the yarn 1a. Circuits for the differential amplifier 5a, the waveform shaper 6a are arranged on a printed circuit board 24. Alternatively, when it is bendably made of a flexible material, the induction electrodes 3a and 4a may be arranged together with the circuits for the differential amplifier 5a and waveform shaper 6a on the printed circuit board 24. The casing 18 is preferably integrally formed of a conductive plastic material which exhibits an electrostatic shielding effect. The casing 18 is formed at a portion thereof above the window 25 for the electrodes 3a and 4a with a mounting hole 21 through which the snail wire 20a is inserted. Also, the casing 18 is formed with a hole through which the indication lamp 7 is projected and a small hole 26 into which a mounting pin 22 is inserted. The printed circuit board 24 is arranged in the casing 18. The mounting hole 21, as shown in FIG. 3, is formed into an elliptic shape in section so as to correspond to a sectional configuration of the snail wire 20a. Also, the mounting hole 21 is formed on one side thereof with a gap, so that the snail wire 20a may be inserted at an intermediate portion thereof into the mounting hole 21 while keeping the mounting hole inclined, as indicated at phantom lines in FIG. 3. The small hole 26 is provided on a side of the casing 18 opposite to the mounting hole 21. Thus, the mounting pin 22 is engagedly held between the small hole 26 and an edge of the lappet 19a, so that the casing 18 and therefore the detector 2a is mounted on the lappet 19a. Likewise, the detectors 2b to 2n are constructed and mounted on the lappets 19b to 19n in the same manner as described above in connection with the detector 2a.

The feed section 9 and detectors 2a to 2n may be arranged in a manner as shown in FIGS. 2 and 4. FIG. 4 shows arrangement of a plurality of the detectors 2a to 2n. In FIGS. 2 and 4, the spinning machine includes a lappet frame 27, on which the lappets 19a to 19n are arranged. Then, the detectors 2a to 2n are mounted on the lappets 19a to 19n in the manner as described above, respectively. The feed section 9 includes a channel member 28 made of, for example, aluminum and mounted on the lappet frame 27. In the channel member 28 are arranged the shift circuits 10a to 10n and feed line 11. The shift circuits 10a to 10n include shift registers for two spindles which are formed of a single printed circuit and are connected through the connectors 8a to 8n to the detectors 2a to 2n, respectively. Also, the shift circuits 10a to 10n are connected through pressedly mounted connectors 29a to 29n to the feed line 11, respectively, and an end of the feed line 11 is connected to the control section 12.

Now, the manner of operation of the yarn breaking detecting device of the illustrated embodiment described above will be described hereinafter with reference to FIGS. 5A and 5B.

Figure 5A:
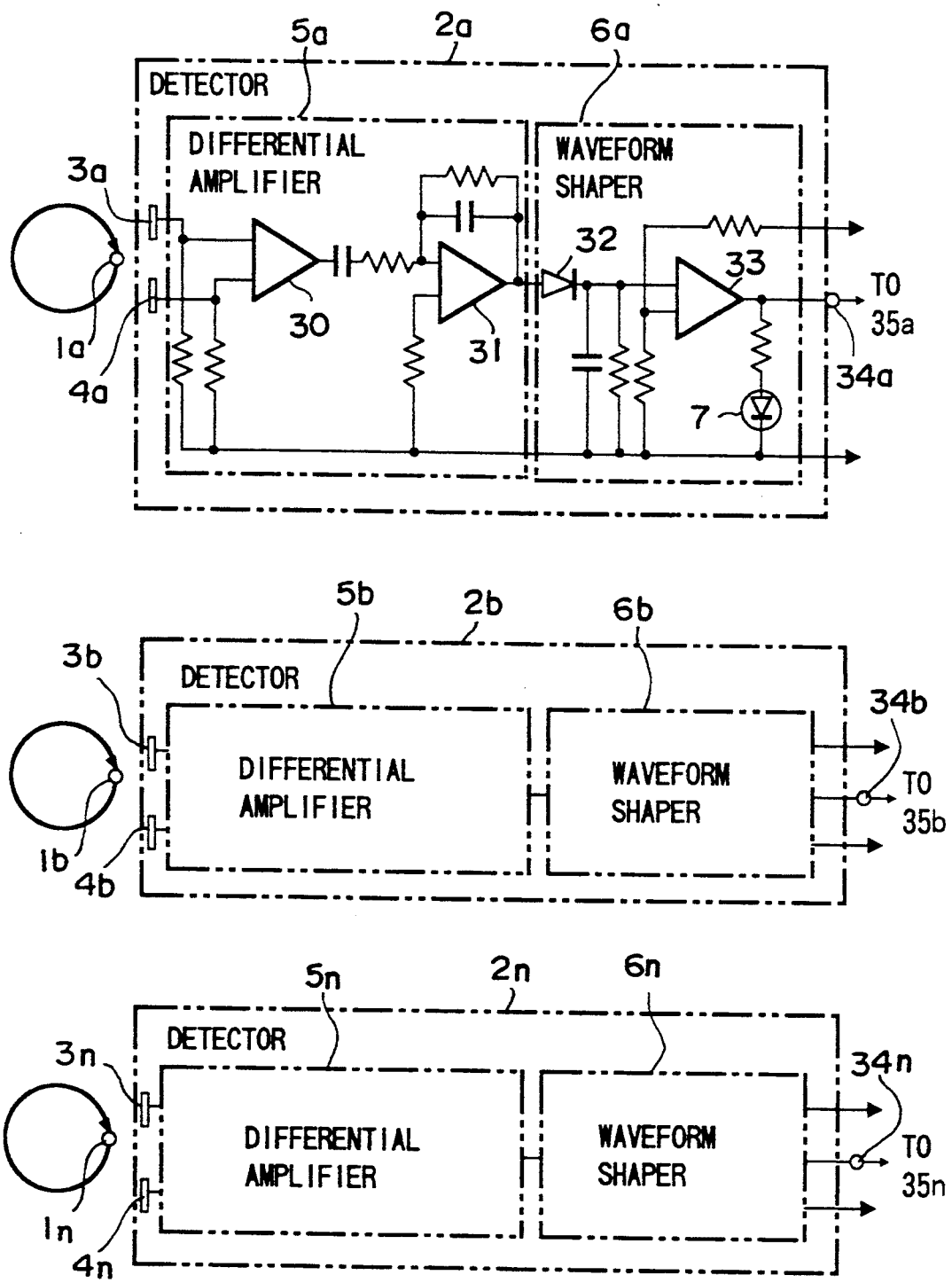
FIGS. 5A and 5B each are a circuit diagram of the yarn break detecting device shown in FIG. 1.
Figure 5B:
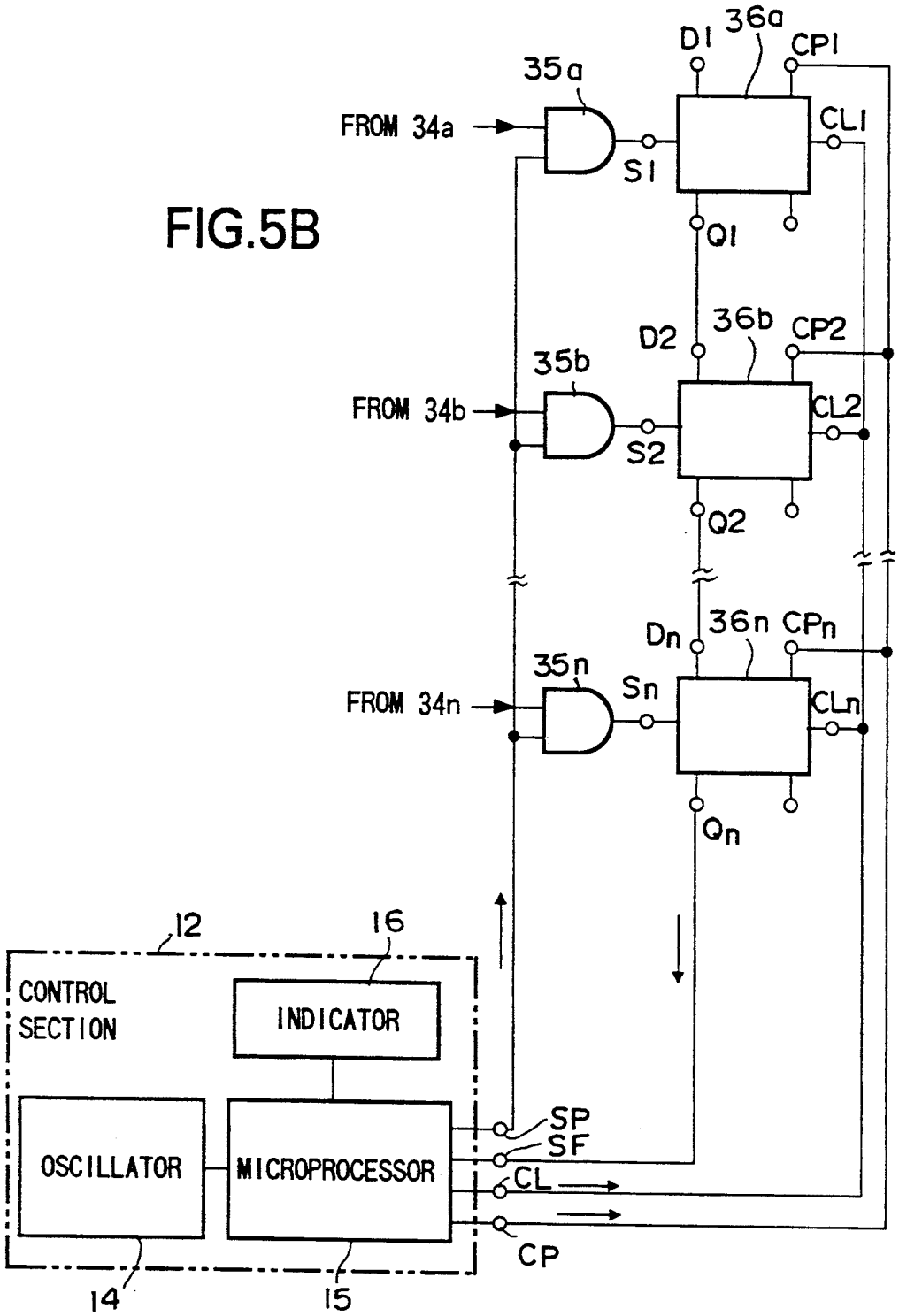

FIG. 5A and 5B show an electric circuit including the detectors 2a to 2n, feed section 9 and control section 12, wherein the differential amplifiers 5a to 5n each comprise a differential amplifying IC 30 of a high input resistance value and an AC amplifying IC 31. When a signal input to the differential amplifying IC 30 has the same phase and potential, it does not produce an output because of offsetting; whereas when the input signal has a different phase, it generates an output in the form of a signal. More particularly, when potentials induced by the electrodes 3a and 4a are indicated at ea and eb, respectively, an output signal of the differential amplifying IC 30 is represented by e and an amplification ratio of the differential amplifying IC 30 is represented by $\beta$, the output signal of the differential amplifying IC 30 is represented by the following equation:

$$ea-eb=\beta e$$

Therefore, when the yarn 1a travels in proximity to the electrodes 3a and 4a, static electricity charged on the yarn 1a causes the electrodes 3a and 4a to induce a signal of an indefinite frequency, to thereby produce a potential corresponding to a difference in phase as an output signal based on the above-described equation.

When the yarn 1a is broken, the potential which has been induced by the electrodes 3a and 4a depending on the static electricity charged on the yarn 1a is extinguished, so that the output signal is not produced. Also, it would be considered that any noise is electrostatically induced across the induction electrodes 3a and 4a due to any stationary object such as a human body or the like or a pulse-like noise is electrostatically induced across the induction electrodes 3a and 4a due to transmission thereto from the power supply or the like. However, such a noise does not cause the differential amplifying IC 30 to produce any output because it has the same phase and potential. The output of the differential amplifying IC 30 is then amplified by the AC amplifying IC 31 and then converted into a DC signal 1-$\phi$ by the waveform shaper 6a including a rectifier 32, a comparator 33 and the like. More particularly, the detector 2a produces, through an output terminal 34a thereof, signals $\phi$ and 1 when the yarn travels and is broken, respectively, so that the signal 1 turns on the indicator lamp 7, so that yarn break may be indicated.

Now, the equation $ea-eb=e\beta$ described above will be described with reference to FIG. 6.

Figure 6:
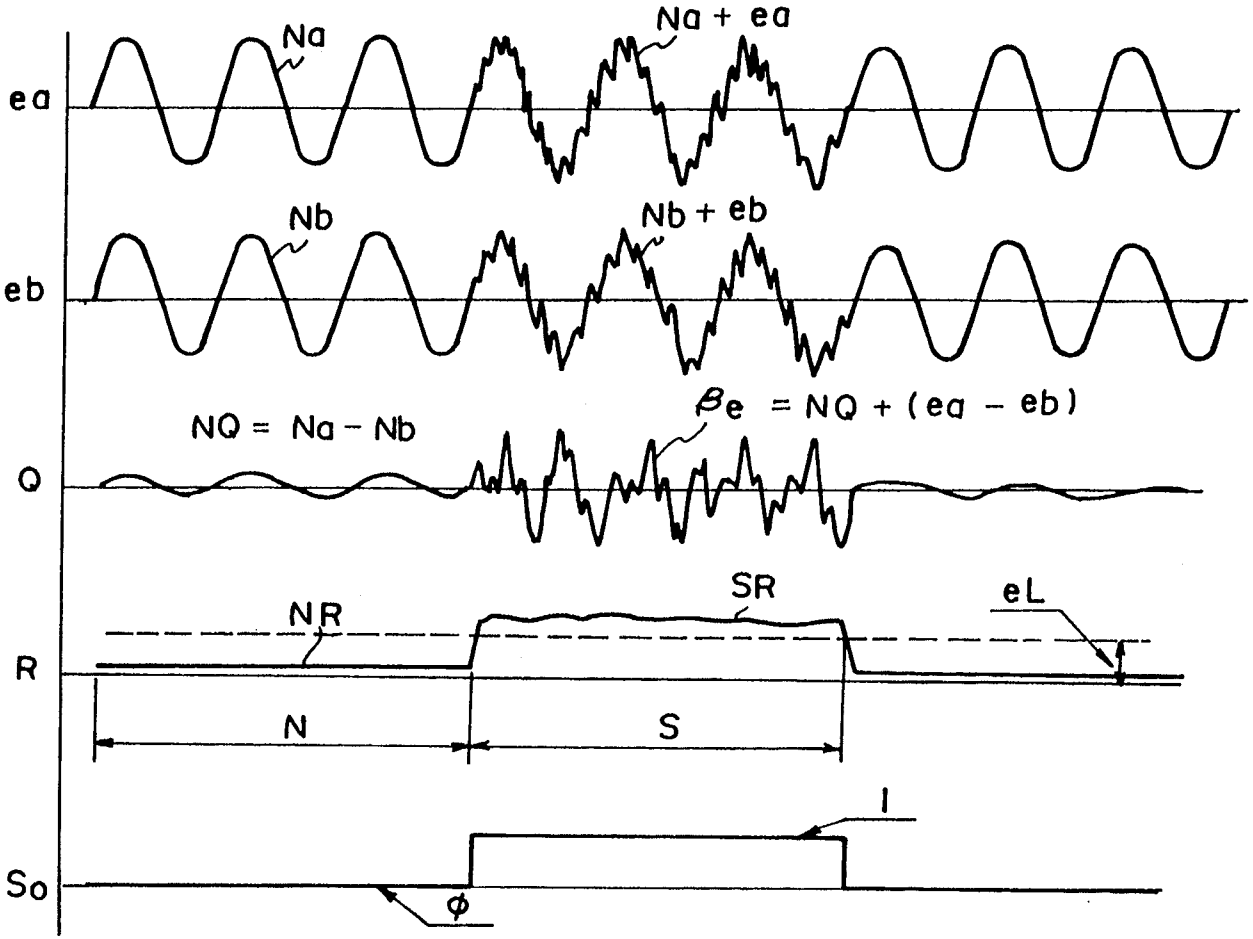
FIG. 6 is a wave form chart showing a wave form of each of elements of the yarn break detecting device of FIG. 1.

Across the electrodes 3a and 4a are induced the signals ea and eb, respectively. In FIG. 6, an axis of abscissae represents time, wherein N indicates an interval of yarn break and S indicates an interval of traveling of the yarn. An axis of ordinates represents the magnitude of a potential and a phase.

At the interval N of yarn break, across the electrodes 3a and 4a are induced noises Na and Nb of a commercial frequency through a human body or the like from various power sources. Also, across the electrodes 3a and 4a are induced pulse-like noises transmitted from the power supply line. Such noises have substantially the same phase and potential, so that the differential amplifying IC 30 merely produces an output in a slight amount due to offsetting between the noises. This results in a noise potential being $NQ=Na-Nb$ shown in FIG. 6.

At the interval S of traveling of the yarn, when yarn travel signals are indicated at ea and eb, respectively, potentials induced across the induction electrodes 3a and 4a due to the signals are superimposed on noise potentials Na and Nb, resulting in being $Na+ea$ and $Nb+eb$ shown in FIG. 6, respectively. In this instance, a signal Q output from the differential amplifier 5a results in being $\beta e=NQ+(ea-eb)\approx ea-eb$, so that offsetting between potentials of the signals ea and eb at each of phases is output in the form of a signal like e shown in FIG. 6 from the differential amplifier 5a. The output is then rectified as indicated at R through a rectifier 32 arranged in the waveform shaper 6a, resulting in signals of waveforms indicated at NR and SR in FIG. 6 being obtained at the yarn break and yarn traveling, respectively. Then, the signals are compared with a comparison level eL set in a comparison IC 33 to discriminate yarn break, so that the waveform shaper 6a outputs a yarn break signal So in the form of a signal 1-$\phi$ through the output terminal 34a.

The yarn break signals S output from the output terminals 34a to 34n of the detectors 2a to 2n, as shown in FIG. 5B, function to set JK.ICs 36a to 36n through logic ICs 35a to 35n and then are fed to the microprocessor 15 in the control section 12. The JKICs 36a to 36n have data input terminals D1 to Dn and data output terminals Q1 to Qn connected to each other in series in order. Also, the JKICs 36a to 36n have clock pulse terminals CP1 to CPn to which clock pulses CP are applied in parallel, resulting in a shift register circuit being constructed. First, one of inputs of each of logic ICs 35a to 35n by a two-input AND gate is fed with a set pulse SP, and outputs of the logic ICs 35a to 35n are fed to parallel terminals S1 to Sn of the JKICs 36a to 36n, resulting in the input terminals D1 to Dn being set. In this instance, only the JKIC corresponding to the detector 2a from which the yarn break signal is produced, for example, the JKIC 36a is set. Then, when signals of the same number of pulses as the number n of the detectors are fed from the clock pulse terminals CP to the clock pulse input terminals CP1 to CPn, a set signal of the JKIC 36a set corresponding to yarn break is subsequently shifted in the JKICs 36a to 36n and then fed from a shift signal input terminal SF to the microprocessor 15. Then, when the number of pulses from the shift signal input terminal SF reaches the number P of clock pulses, the JKICs 36a to 36n each are cleared by a clear pulse CL and then reset by a set pulse SP. The above-described signal operation is automatically repeated and results of the operation are discriminated by the microprocessor 15, resulting in positions at which yarn break occurs and the number of yarn breaks are displayed at the indicator 16. When data on operation time, the number of rotations of each of a spindle and a draft of the spinning machine, and the like are input to the microprocessor 15, individual time characteristics of yarn break can be determined, to thereby permit a lot of control data required to be obtained.

The number of spindles per one ring spinning machine is within a range of 300 to 800 and required response time of the yarn break detector is 2 to 3 seconds, therefore, a frequency of a shift pulse can be set to a level of about 1 kHz. Thus, the present invention does not require a high-speed microprocessor.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A yarn break detecting device for a ring spinning machine of the type including snail wires and lappets, said yarn break detecting device comprising a plurality of detectors, a power supply means, and a control section, wherein:

each of said plurality of said detectors comprises a pair of electrodes of plate-like conductors said plate-like conductors having a same area, said plate-like conductors being installed on insulating substrate faces and arranged in correspondence to respective yarn balloons, said yarn electrostatically including static electric charge in said plate-like conductors and being run in a shape of balloon in said snail wires, a differential amplifier of high input impedance value for differentially amplifying a signal induced in said pair of electrodes, a waveform shaper for comparing an output signal of said differential amplifier and a signal of a standard value in order to perform a waveform shaping, an indicator lamp turned on by an output signal of said waveform shaper, a plurality of casings made of a conductive plastic material having static electrically shield effect and each of said plurality of casings having installed therein each of said plurality of said detectors, each of said plurality of said casings is attached to each of said lappets by means of mounting holes formed through each of said snail wires attached to each if said lappets installed in the ring spinning machine and mounting pins made of elastic material, said power supply means is connected to said each of said plurality of detectors through connectors and includes shift circuit means for selecting an output signal from each of said plurality of detectors and for supplying electric power to each of said plurality of detectors through electricity supply lines, and said control section is connected to terminals of said power supply means and includes a stabilized direct current electricity power source for supplying a direct current power source to said electricity supply lines, an oscillator for driving respective shift circuit means, a microprocessor operated in synchronism with said oscillator for processing the output signals from each of said plurality of detectors selected by the shift circuit means, and an indicator means for indicating the number of yarn breaks determined by the microprocessor based upon the output signal from each of said plurality of detectors.

* * * * *